US006217193B1

(12) United States Patent
Won

(10) Patent No.: US 6,217,193 B1
(45) Date of Patent: Apr. 17, 2001

(54) ORNAMENTAL LAMP STRINGS IN NETWORK STRUCTURE

(76) Inventor: Jen-Chen Won, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/430,705

(22) Filed: Oct. 29, 1999

(51) Int. Cl.[7] ..... F21V 21/00
(52) U.S. Cl. ..... 362/249; 362/123; 362/806
(58) Field of Search ..... 362/249, 123, 362/396, 252, 806, 234

(56) References Cited

U.S. PATENT DOCUMENTS 5,601,361 * 2/1997 Lawerence ..... 362/249
5,645,342 * 7/1997 Chang ..... 362/249
5,662,409 * 9/1997 Huang ..... 362/249
5,775,802 7/1998 Kuo .
5,800,046 * 9/1998 Lin ..... 362/249
5,934,793 * 8/1999 Rahman ..... 362/249
6,048,077 * 4/2000 Pan ..... 362/123

* cited by examiner

*Primary Examiner*—Thomas M. Sember
(74) *Attorney, Agent, or Firm*—Dougherty & Troxell

(57) ABSTRACT

Ornamental lamp strings in a network structure, having a main power-supply cable and a plurality of lamp strings. The plurality of lamp strings all have the same length and the same number of sockets spaced apart a common distance. The odd-numbered sockets of one lamp string are connected to the even-numbered sockets of an adjacent lamp string by a knitting cord without copper wire so as to have all the lamp strings knitted into a network.

1 Claim, 8 Drawing Sheets

ORNAMENTAL LAMP STRINGS IN NETWORK STRUCTURE

BACKGROUND OF THE INVENTION

1. Field of the Invention

This invention relates to a Christmas ornamental lamp, and particularly to a network knitted with a plurality of lamp strings.

2. Description of the Prior Art

In the conventional lamp strings for Christmas ornament, the ornament usually comprises an independent power-supply wire connected, in series, with a plurality of sockets, and the last socket on the tail end thereof is connected with an independent wire. Two independent power-supply wires are then twisted together to form into a lamp string; all the sockets in one lamp string are mounted with bulbs respectively so as to form into a lamp string for Christmas ornament.

The conventional lamp string for Christmas ornament can also be mounted on a wall surface or a wide plane; as shown in FIG. 7, a plurality of lamp strings are connected with and under a main power-supply cable. The two independent power-supply wires of every lamp string are not twisted; the sockets of two adjacent lamp strings are arranged in intersection shape. The independent power-supply wire of one lamp string and the sockets of another lamp string are held together by means of a clasper so as to knit all the lamps into a network of ornament; the aforesaid prior art is published in U.S. Pat. No. 5,775,802; the independent power-supply wires of the prior art are hung under the main power-supply cable; the number of strands of the power-supply wire and the diameter thereof have been increased properly so as to withstand pulling unintentionally.

In another conventional network of ornamental lamp strings as shown in FIG. 8, it comprises a plurality of twisted lamp strings to be connected with a main power-supply cable; all the lamp strings are hung under the main power-supply, and the sockets of two adjacent lamp strings are arranged in intersection shape, and then the sockets of one lamp string and the power-supply wire of an adjacent lamp string are fastened together by means of claspers so as to form into a network of ornamental lamp strings; finally, a socket on the tail end of every two adjacent lamp strings will be unable to hold stably as a result of the intersection arrangement, and that socket is subject to swaying in the wind.

SUMMARY OF THE INVENTION

The prime object of the present invention is to provide a network of ornamental lamp strings, in which the main power-supply cable is connected with several lamp strings on one side thereof; all the lamp strings have the same length and the same number of sockets arranged at a regular distance. The sockets between two adjacent lamp strings are connected together by means of a knitting cord so as to knit all the lamp strings into a network of ornamental lamp strings.

Another object of the present invention is to provide a network of ornamental lamp strings, in which every lamp string in the network is knitted with a knitting cord, and then all the sockets of the lamp strings are arranged in a regular order, and the edge thereof is knitted with a knitting cord without copper wire to form into an edge of the network so as to facilitate the same to be hung in place.

Still another object of the present invention is to provide a network of ornamental lamp strings, in which every lamp string is twisted with two power-supply wires, and the tension force of every lamp string is within a safety limit; after the lamp strings are knitted into a network, the tension force of each lamp string will not be affected.

A further object of the present invention is to provide a network of ornamental lamp strings, in which all the lamp strings have the same length, and are connected to one side of the main power-supply cable; all the lamp strings are knitted into a network of ornamental lamp strings, and such a network is simple and easy in terms of mounting in place.

DETAILED DESCRIPTION OF THE PREFERRED EMBODIMENT

Figure 1:
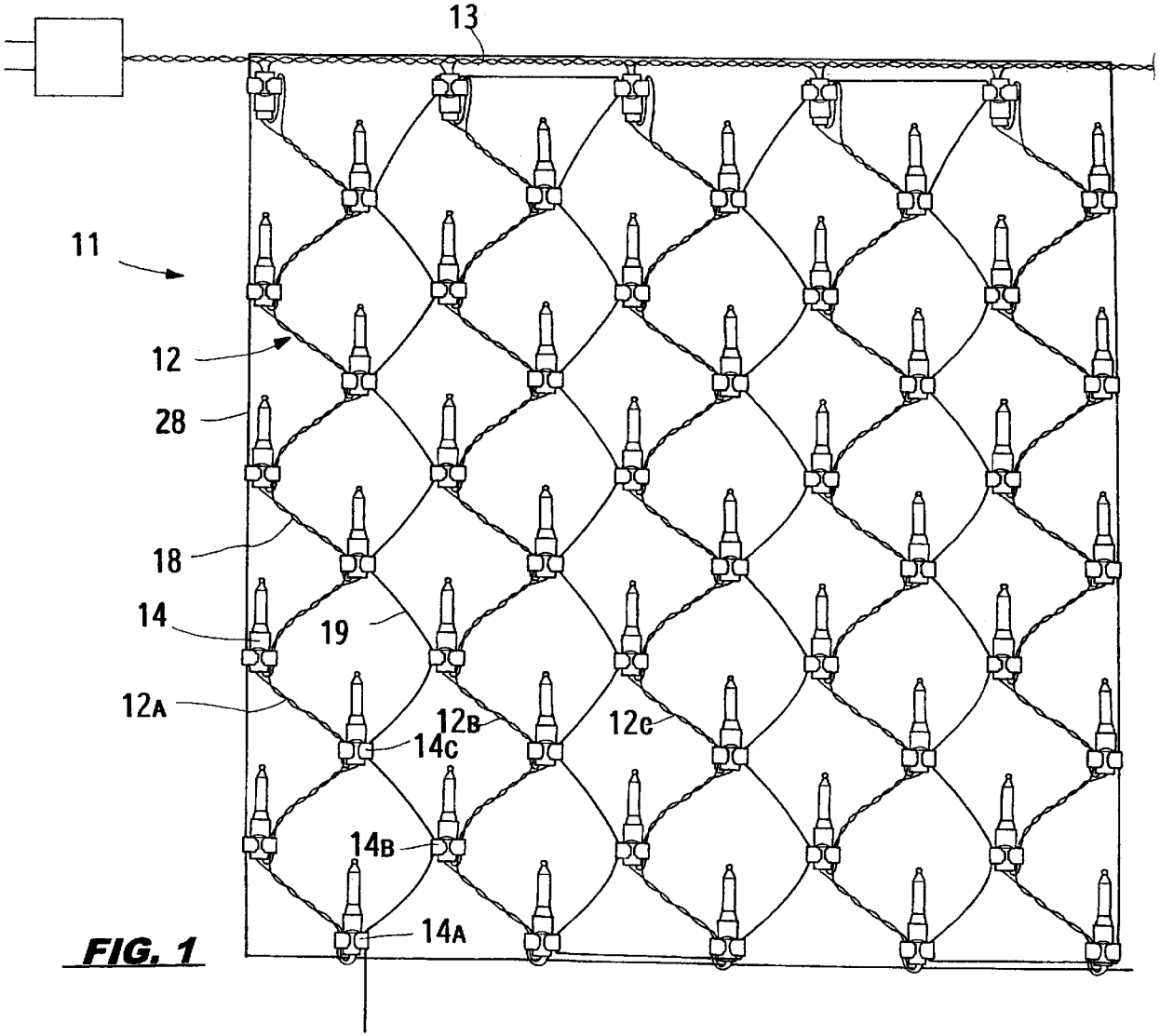
FIG. 1 is a plan view of the present invention, showing a network formed with a given number of lamp strings.
Figure 2:
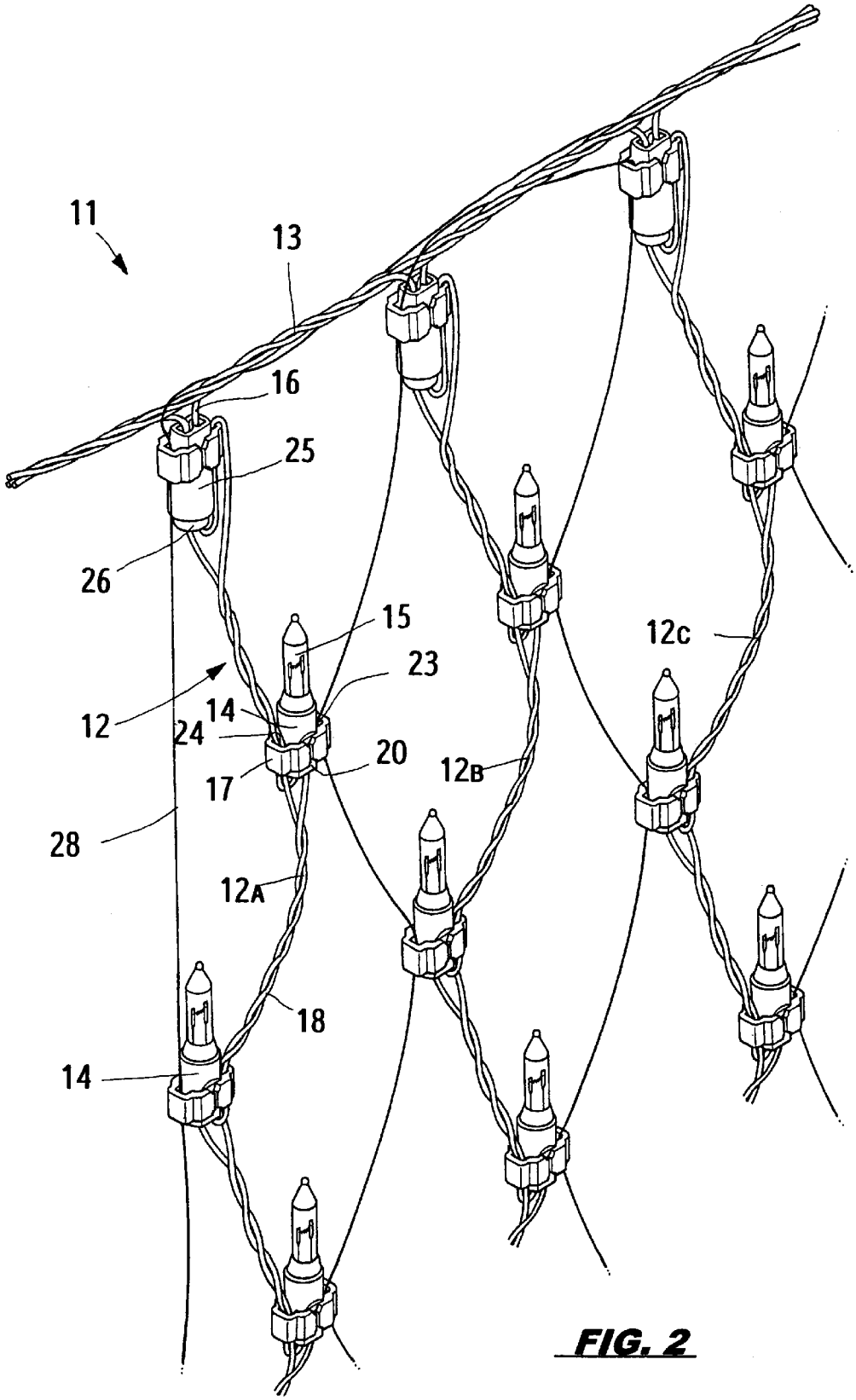
FIG. 2 is a perspective view of the present invention, showing a main power-supply cable mounted with a given number of connectors which are used for plugging a given number of lamp strings so as to form into a network.

Referring to FIGS. 1 and 2, the present invention relates to a network 11 of ornamental lamp strings, and it comprises a main power-supply cable 13 and a plurality of lamp strings 12; the lamp strings are knitted into a network by means of knitting cords 19 without copper wire; one side of the main power-supply cable 13 is connected with several lamp strings 12 having same length; every lamp string 12 is mounted with the same number of sockets 14 to be arranged at a regular distance one another. Every two adjacent lamp strings 12 are connected together with a knitting cord 19 without copper wire from the first socket of the outer lamp string. On a working bench, the sockets of every two adjacent lamp strings 12 are connected into a network 11 by means of knitting cords 19 without copper wire from the first socket of the outer lamp string. On a working bench, the sockets of every two adjacent lamp strings 12 are connected into a network 11 by means of knitting cords 19.

Referring to FIGS. 1 to 5, the main power-supply cable 13 of the network 11 comprises at least two power-supply wires twisted together. One side of the main power-supply cable 13 is connected with several lamp strings 12. Every lamp string 12 includes two independent power-supply wires 18, of which one power-supply wire connects with a plurality of sockets 14 in series and at a regular distance one another; then, the two power-supply wires are twisted together to form into one independent lamp string 12. Several lamp strings 12, at the same length, are connected with the main power-supply cable 13, and every lamp string 12 includes the same number of sockets 14 arranged at a regular distance. When the main power-supply cable 13 is hung in place, every lamp string 12 will be hung vertically under the main power-supply cable 13; the lower ends of all the lamp strings 12 will be at the same level, and the same is true of the sockets 14 thereof.

Figure 4:
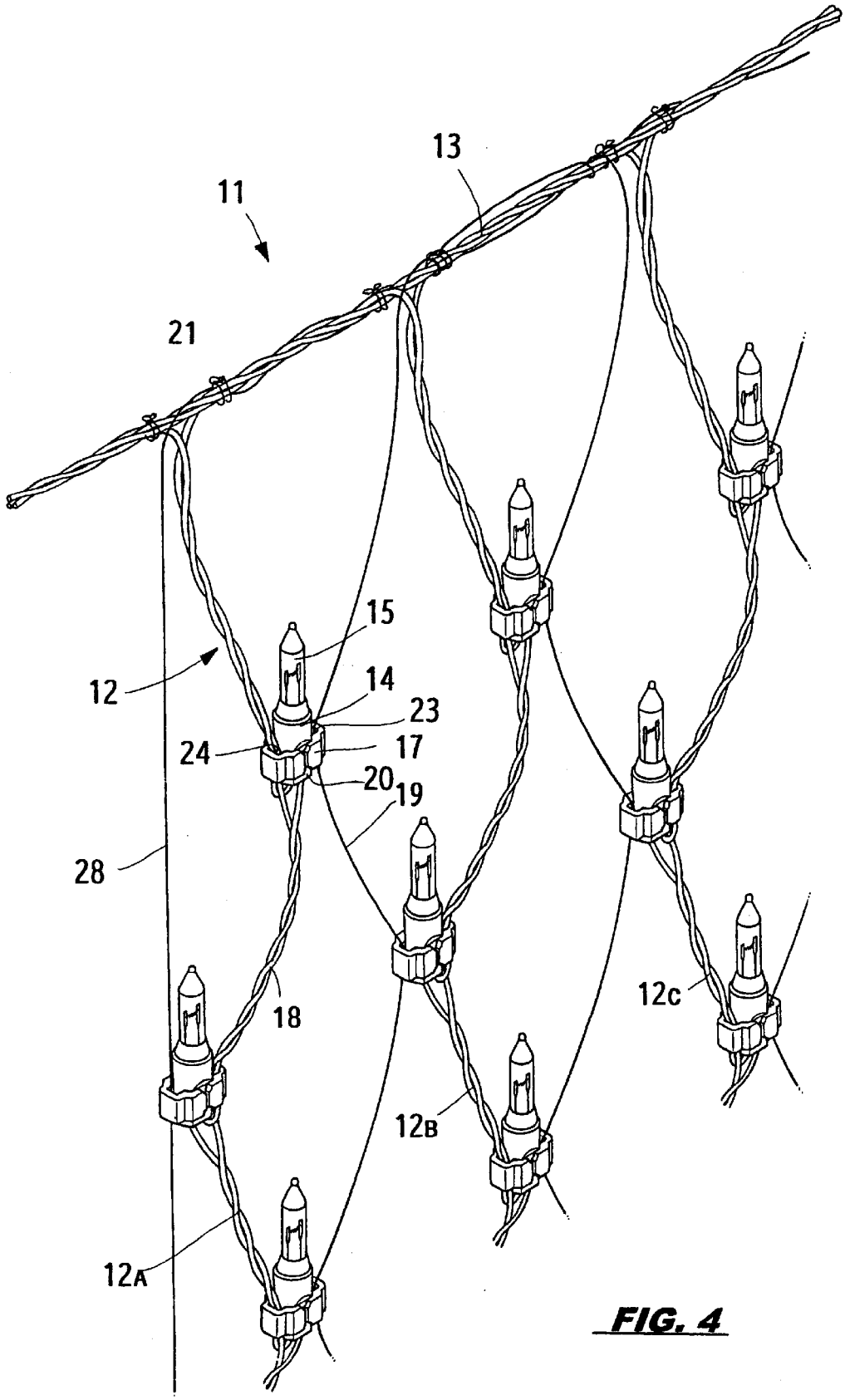
FIG. 4 is a perspective view of the present invention, showing a main power-supply cable connected with a plurality of lamp strings to form into a network.
Figure 5:
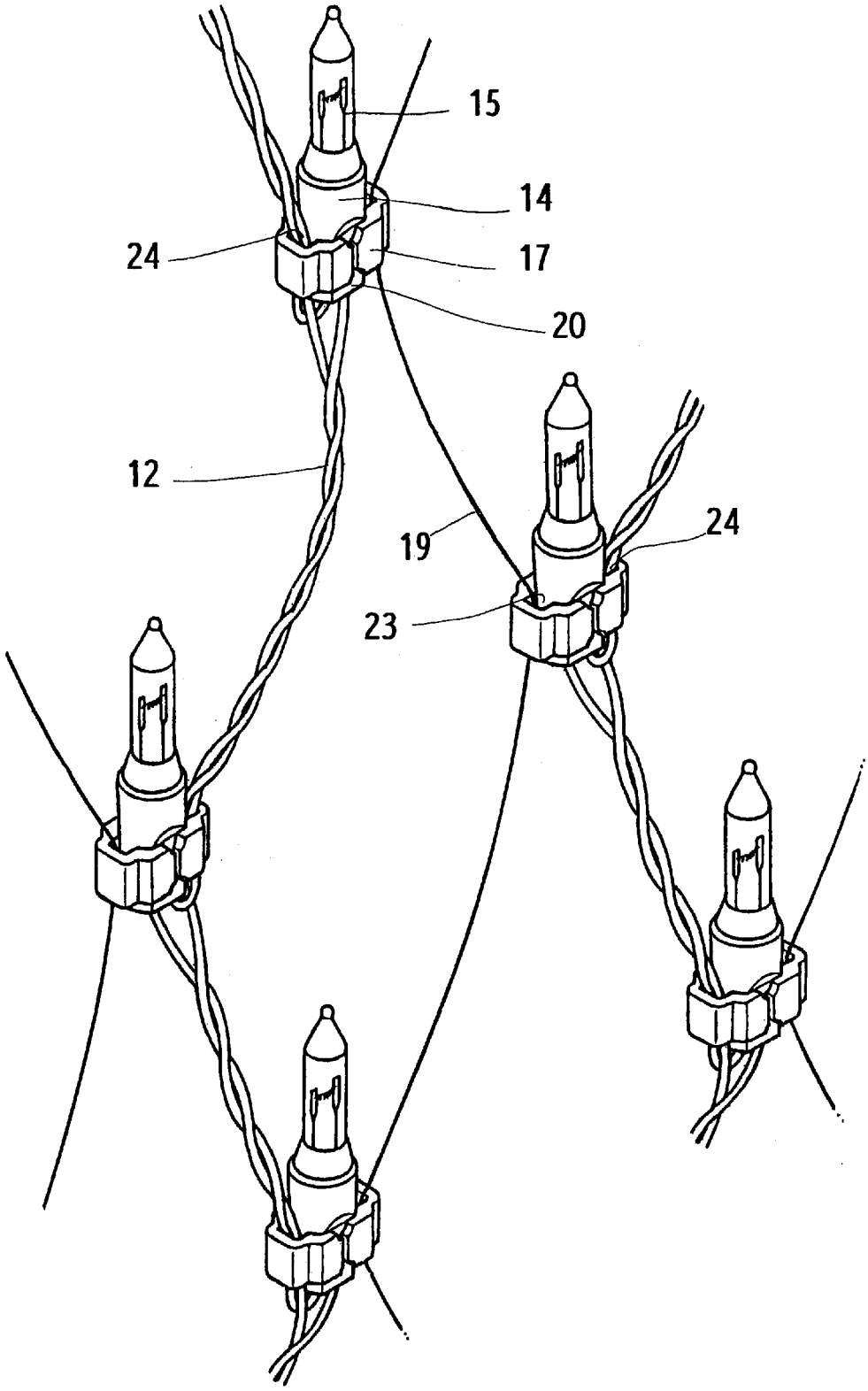
FIG. 5 is a perspective view of the present invention, showing the sockets connected with the knitting cord by means of holding rings respectively.

Referring to FIG. 2, the main power-supply cable 13 of the network 11 is connected with several connecting wires 16, of which each is connected with a connector 25. One end of each power-supply wire of each lamp string 12 is connected with a connector 26; every lamp string 12 includes the same number of sockets 14 to be arranged at a regular distance. All the lamp strings have the same length; after the lamp strings are connected with the main power-supply cable 13 by means of plugging members 26 and the connector, the main power-supply cable 13 can be hung in place and all the lamp strings 12 will be hung under the main power-supply cable 13. As shown in FIG. 4, the main power-supply cable 13 is connected with several lamp strings 12 having the same length. The connecting point between the main power-supply cable 13 and the lamp string 12 is wound around with a tying string 21 to fasten the aforesaid two.

Every socket 14 in each lamp string 12 is mounted with a holding ring 17 on a rectangular base 20, and simultaneously the power-supply wires 18 are put in a clipping groove 24 on one side of the rectangular base 20, while a knitting cord 19 without copper wire is inserted in a clipping groove 23 on other side of the holding ring 17. After the holding ring 17 is fastened to the rectangular base 20 of the socket 14, the knitting cord 19 without copper wire will hold the sockets 14 of the two adjacent lamp strings 12 together.

Figure 3:
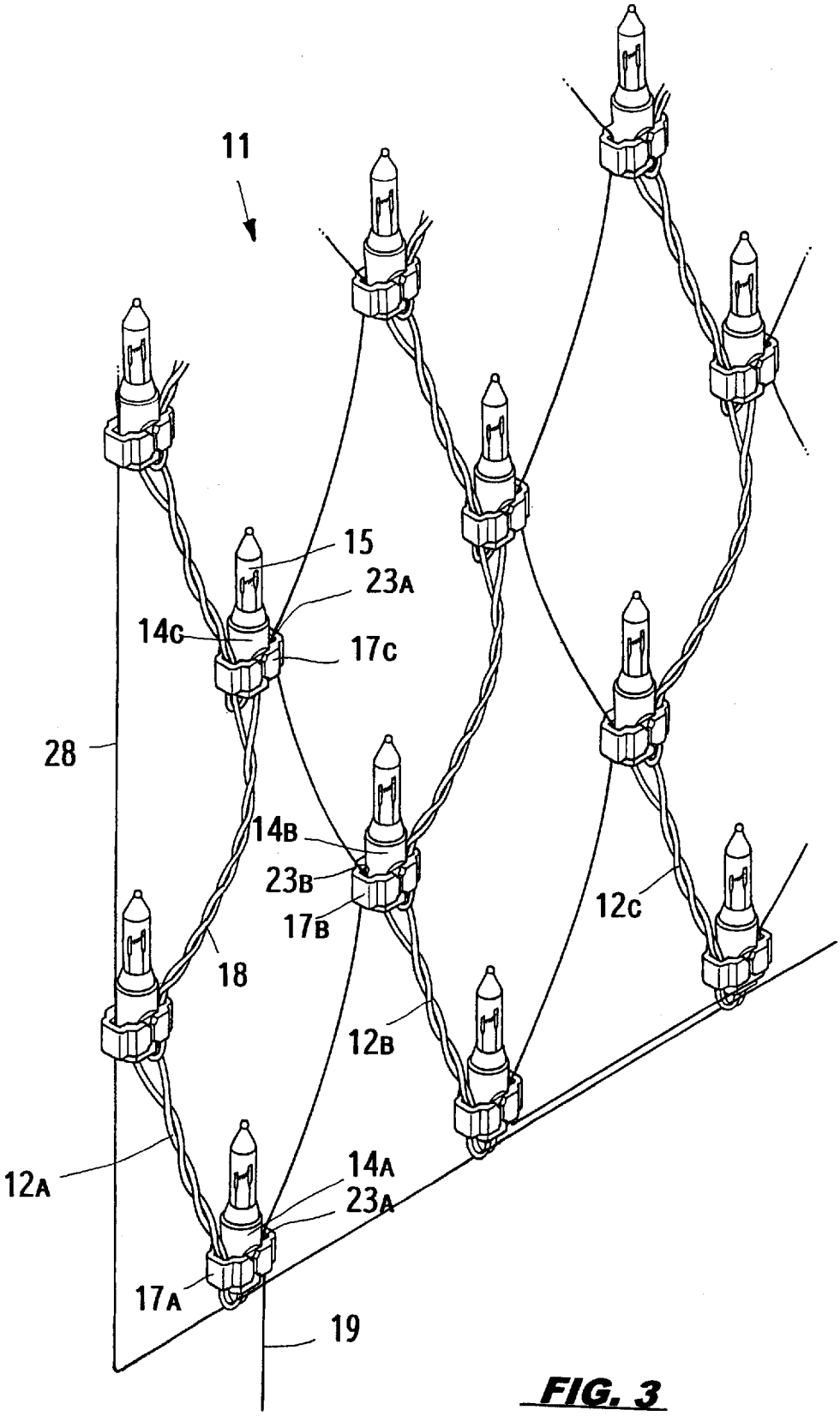
FIG. 3 is a perspective view of the present invention, showing the first lamp string being mounted on a knitting cord.

The knitting cord 19 is made of plastic threads without copper wire; as shown in FIGS. 2 and 3, the socket 14A of the first lamp string 12A under the main power-supply cable 13 is mounted with a holding ring 17 for holding a knitting cord 19 in the clipping groove 23A of the socket 14A; then, the knitting cord 19 is directed to the second socket 14B of the second lamp string 12B at a diagonal angle; likewise, the knitting cord 19 will be held in the clipping groove 23B of the socket 14B by means of a holding ring 17B; then, the knitting cord 19 is directed to the third socket 14C of the first lamp string 12A, and is fixed in the clipping groove 23A of the third socket 14C. By the same way, the first and second lamp strings 12A and 12B will be knitted together; then, the knitting cord 19 is directed to the top of the third lamp string 12C from the second lamp string 12B to have the sockets of the second and third lamp strings 12B and 12C knitted together diagonally. After all the lamp strings 12 connected with the main power-supply cable 13 are knitted together, the knitting cord 19 will be laid along the outer edge of the network 11 as a mounting cord 28 for the main power-supply cable 13 and the lamp strings 12.

Figure 6:
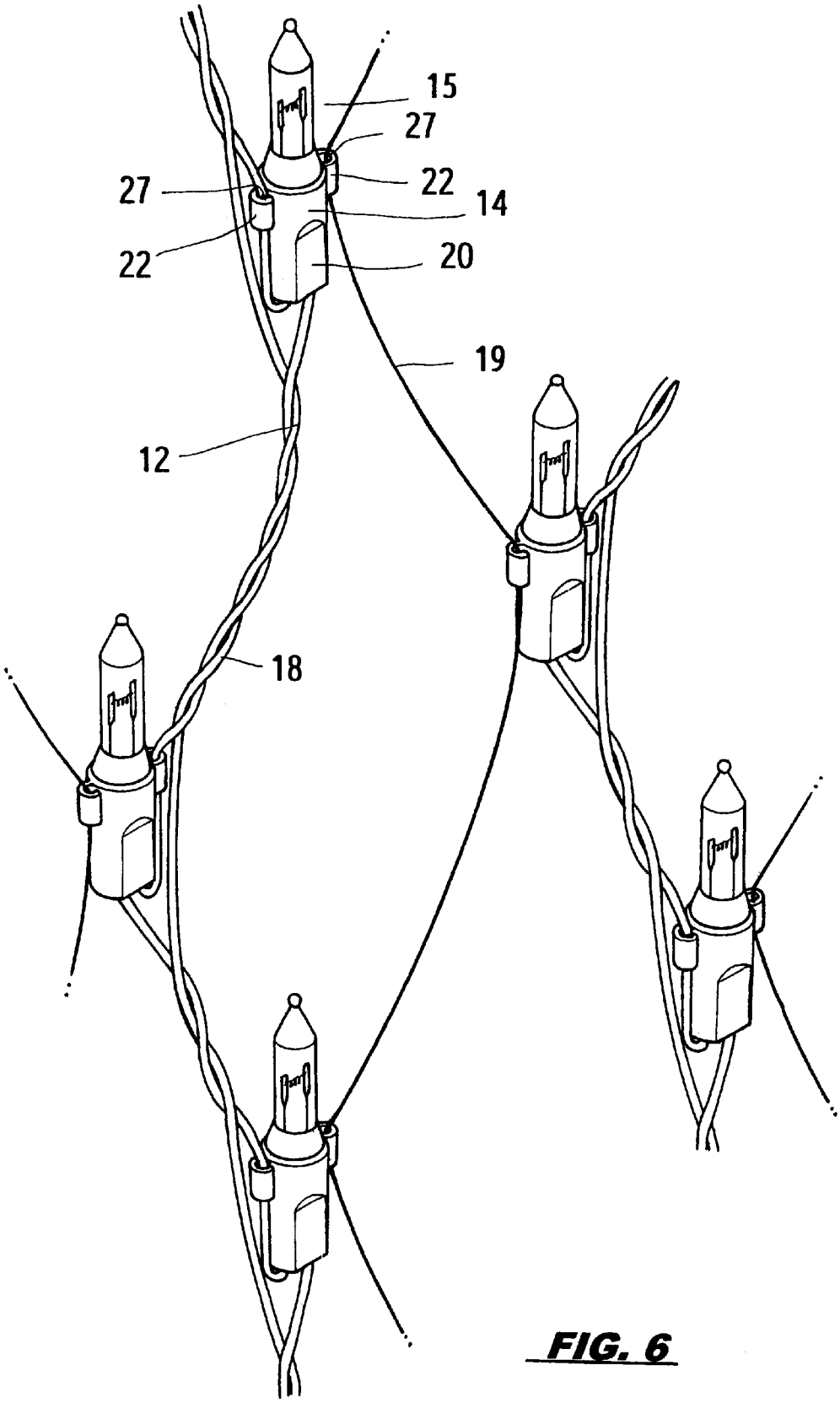
FIG. 6 is a perspective view of the present invention, showing the side part of socket having a clipping groove to hold a knitting cord.
Figure 7:
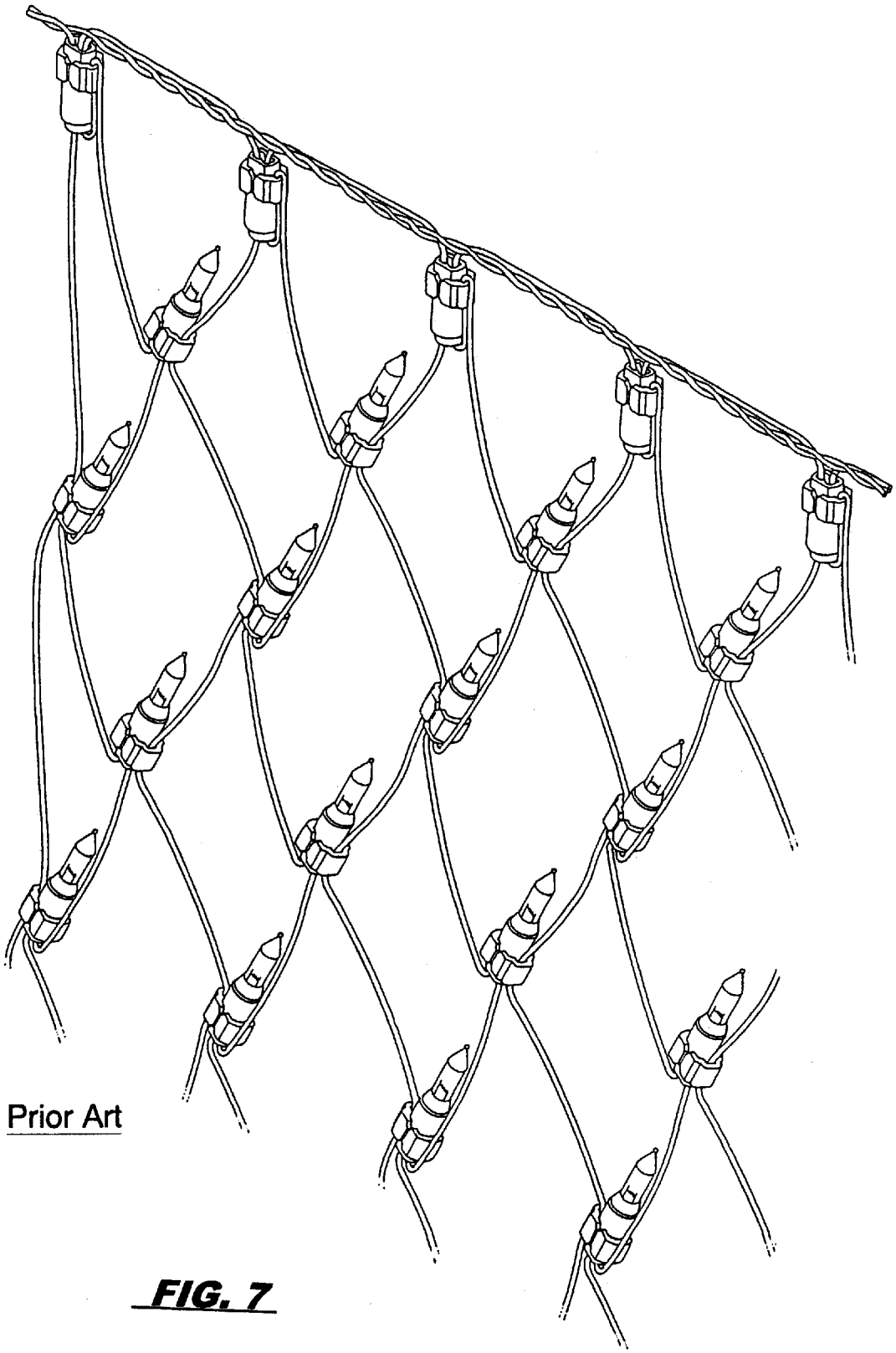
Prior Art FIG. 7
FIG. 7 shows a fragmental portion of a conventional network formed with ornamental lamp strings.
Figure 8:
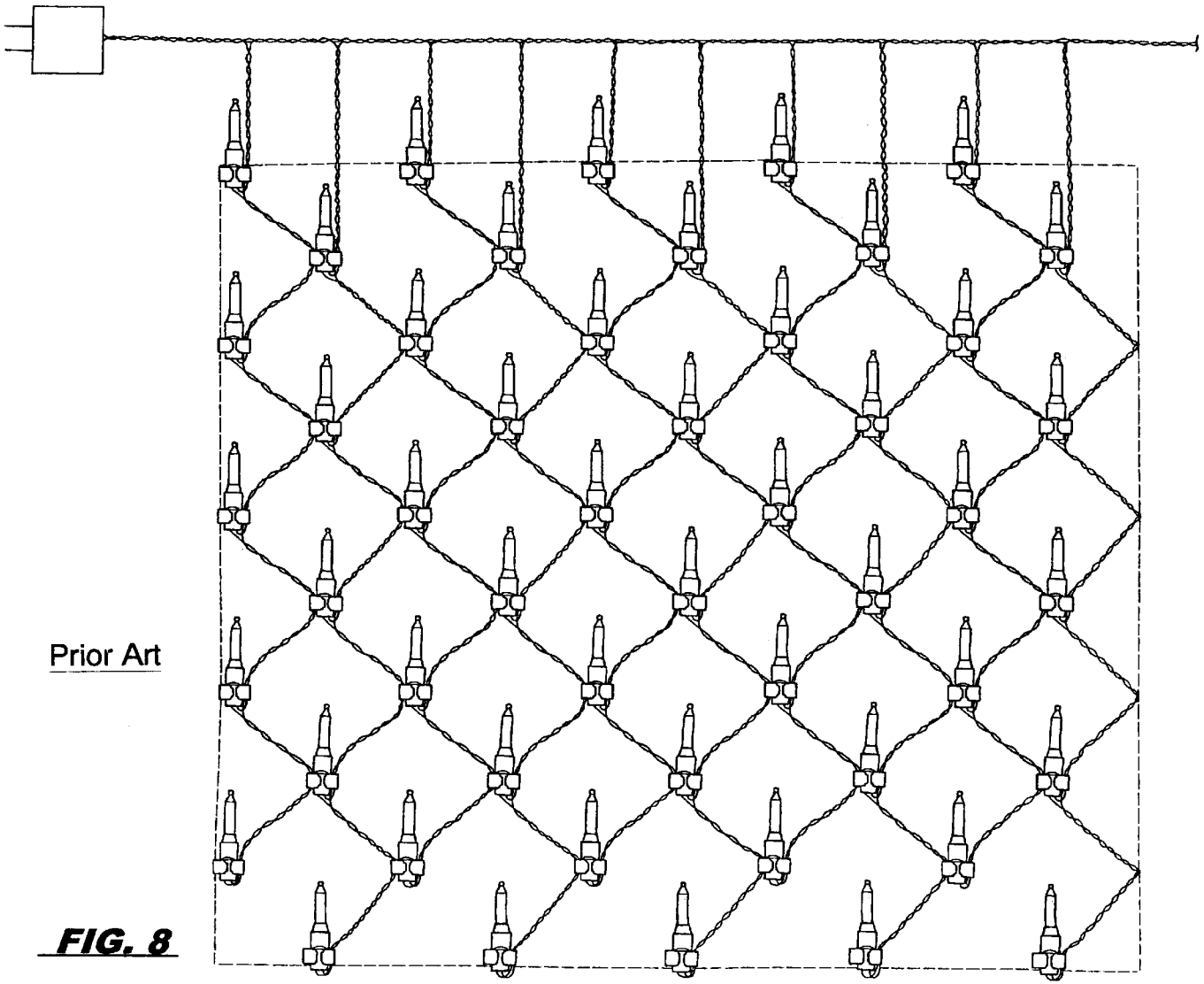
Prior Art FIG. 8
FIG. 8 shows another fragmental portion of a conventional network formed with ornamental lamp strings.

As shown in FIG. 6, both sides of the socket 14 of the lamp string 12 are furnished with two fastening rings 22 respectively; the fastening ring 22 is formed as a short cylinder, and one side thereof has a fastening groove 27 to facilitate a single power-supply wire to press therein. The main power-supply cable 13 is connected with a plurality of lamp strings 12; both sides of every socket 14 of the lamp strings 12 have two fastening grooves 27. Before a network 11 is completed, a power-supply wire 18 of a lamp string 12 should be fastened into a fastening groove 27A on one side first, while the fastening groove 27B on the other side thereof is used for receiving the knitting cord 19 without copper wire; the knitting cord 19 is directed from the first socket of the first lamp string to pass through the fastening groove 27B and then to pass through the rest grooves by following the same method as the aforesaid holding ring 17 does; then, the knitting cord 19 will knit all the sockets of every lamp strings 12 into a network 11 which can be mounted on a wall surface or a wide plane for ornament purpose.

According to the aforesaid description of the embodiment of the present invention, it is apparent that the main power-supply cable 13 of the network is connected with a plurality of lamp strings 12 having an equal length one another, and the sockets 14 of every lamp string 12 are connected together in series at a regular distance one another; two sockets 14 between two adjacent lamp strings are connected by means of a knitting cord 19 without copper wires, which passes only through a holding ring 17 or a fastening ring; then, all the lamp strings will be knitted into a network 11 of ornamental lamps. The edge of the network 11 is attached with a mounting cord 28 to facilitate the network 11 to hang in a place as desired for ornamental purpose.

What is claimed is:

1. An ornamental lamp string in a network structure comprising: a main power-supply cable and a plurality of lamp strings knitted into a network by a knitting cord, said lamp strings all having the same length and the same number of sockets spaced apart the same distance from one another, and sides of each socket furnished with clipping grooves respectively for holding power-supply wires and the knitting cord respectively; said knitting cord having no electrically conducting characteristics, and passing through the clipping grooves of odd-numbered sockets of a first lamp string and through the clipping grooves of even-numbered sockets of a second lamp string adjacent to the first lamp string until all of said plurality of lamp strings are knitted into a network, said knitting cord also extending along an outer edge of said network so as to provide a mounting cord for said network.

* * * * *